United States Patent [19]

Nishioka

[11] Patent Number: 4,465,054

[45] Date of Patent: Aug. 14, 1984

[54] ARCHERY BOW WITH FLEXIBLE FORCE TRANSMITTING LINK ASSEMBLY

[76] Inventor: Jim Z. Nishioka, 1268 Hemlock N.W., Salem, Oreg. 97304

[21] Appl. No.: 377,865

[22] Filed: May 13, 1982

[51] Int. Cl.[3] ..... F41B 5/00

[52] U.S. Cl. ..... 124/24 R; 124/86

[58] Field of Search ..... 124/24 R, 23 R, 41 A, 124/35 A, 22, 90, DIG. 1

[56] References Cited

U.S. PATENT DOCUMENTS 1,885,962 11/1932 Swenson et al. ..... 124/23 R 4,020,819 5/1977 Haines ..... 124/90 X

FOREIGN PATENT DOCUMENTS 2125760 12/1972 Fed. Rep. of Germany .... 124/23 R

*Primary Examiner*—Richard J. Apley

*Assistant Examiner*—William R. Browne

*Attorney, Agent, or Firm*—Eugene M. Eckelman

[57] ABSTRACT

A flexible force transmitting link assembly includes flexible links that extend between the bow limbs and are connectable to a bow string and bow limbs. Connecting link members extend rearwardly and connect a flexible link to a bow string. An arrow, when positioned for firing, engages one of the flexible links.

9 Claims, 4 Drawing Figures

FIG. 1
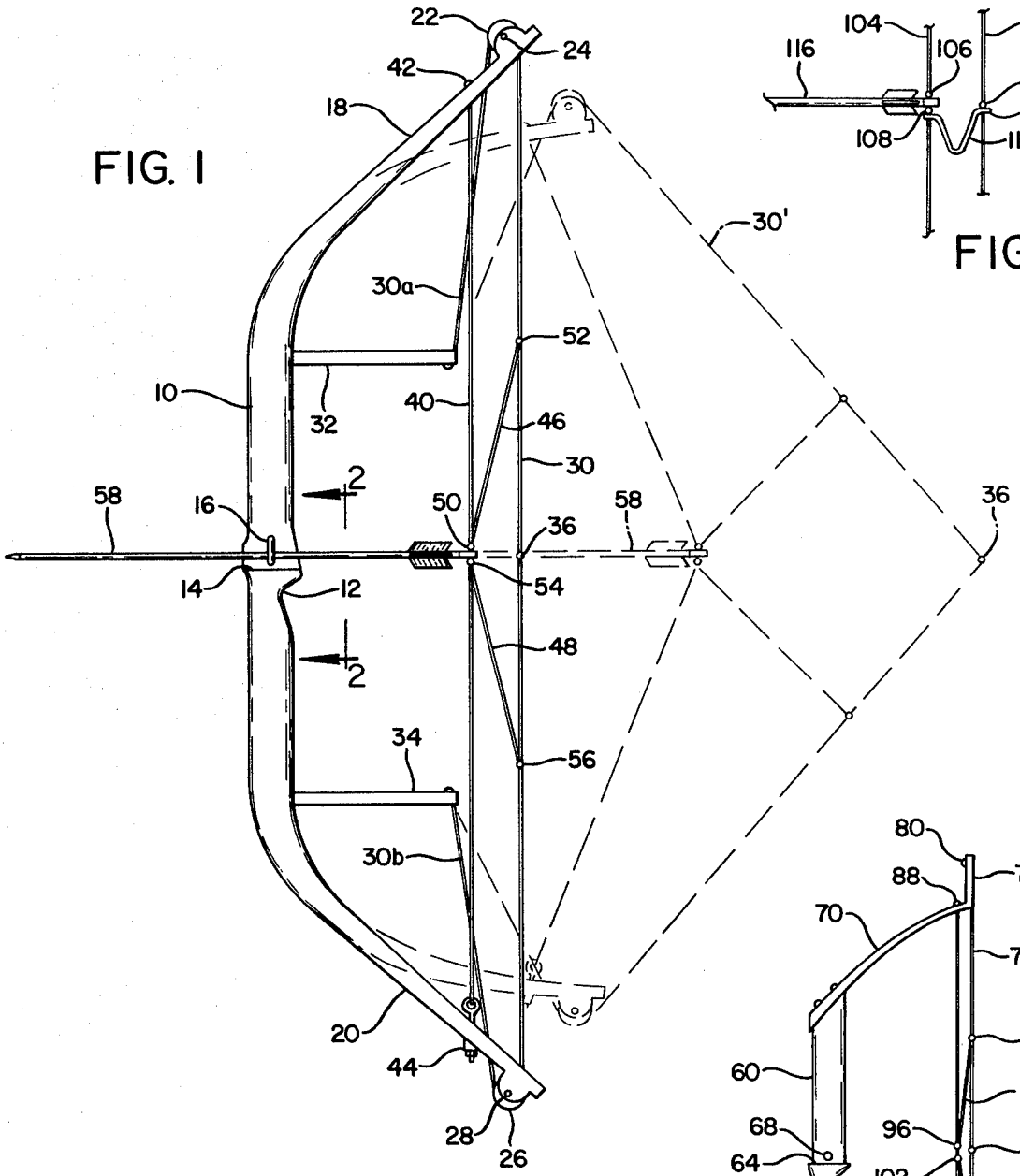
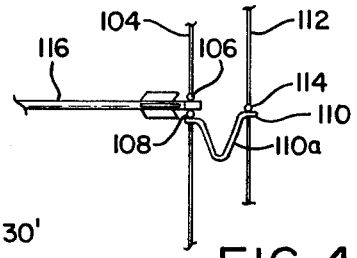
FIG. 4
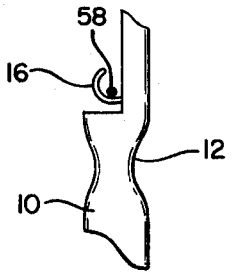
FIG. 2
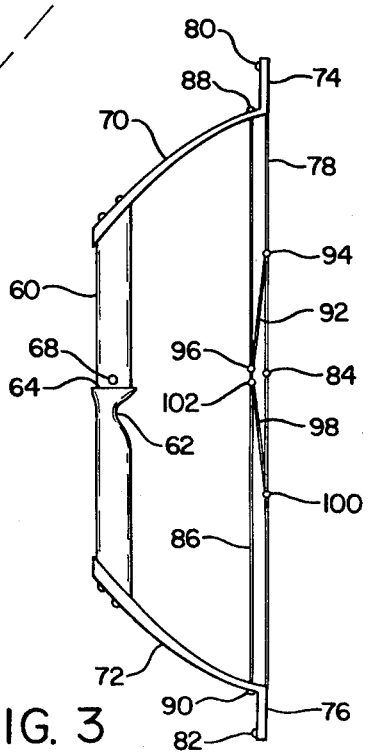
FIG. 3

ARCHERY BOW WITH FLEXIBLE FORCE TRANSMITTING LINK ASSEMBLY

BACKGROUND OF THE INVENTION

This invention relates to new and useful improvements of archery bows and is particularly concerned with a bow capable of shooting an arrow shorter than the customary length.

Many types of bows have been developed for the purpose of shooting shorter arrows. Such bows commonly use a forwardly placed grip or handles. With this type of bow the arrow is drawn rearwardly past the user's hand and an arm guard is used to protect the shooter's hand. An object of this disclosure is to provide a simple bow to achieve the same goals.

SUMMARY OF THE INVENTION

According to the present invention and forming a primary objective thereof an archery bow is provided that is simplified in construction and at the same time has features which will utilize an arrow shorter than the customary length.

In carrying out these objectives, the bow is provided with an assembly which includes a link connected to the flexible arm and the bowstring. The link engages the projectile or arrow and during normal rearward drawing movements the arrow need not be drawn past the user's bow hand. This feature eliminates the need for the arm guard.

The assembly may be used on a variety of bow designs such as the two shown in this disclosure and the need for a special forward handle has been eliminated.

The invention will be better understood and additional objects and advantages will become apparent from the following description taken in connection with the accompanying drawings.

BRIEF DESCRIPTION OF THE DRAWINGS

FIG. 1 is a side elevational view of an archery bow employing principles of the present invention, a drawn position of the bow being shown in broken lines;

FIG. 2 is a fragmentary view taken on the line 2—2 of FIG. 1;

FIG. 3 is a side elevational view of an archery bow employing a modified form of the invention; and FIG. 4 is a fragmentary view of another modified form of the invention.

DETAILED DESCRIPTION OF PREFERRED EMBODIMENTS

With reference first to FIGS. 1–2 which show a first form of the invention, an archery bow includes a frame portion 10 of the usual construction, such frame portion having a grip 12, a projectile or arrow shelf 14 and a projectile or arrow rest 16. A pair of arms 18 and 20 extend oppositely from the frame portion 10. A bowstring guide pulley 22 is supported by shaft 24 on the tip end of arm 18. Another bowstring guide pulley 26 is supported by shaft 28 on arm 20. A bowstring main span 30 extends between the arms 18 and 20 wraps over the guide pulleys 22 and 26 on the arms 18 and 20 respectively. Bowstring end portions 30*a* and 30*b* extend to and are connected to support arms or pylons 32 and 34 respectively. The bowstring end portions 30*a* and 30*b* are commonly referred to as compound cables in the trade. The bowstring 30 includes an enlargement 36 to indicate the area to be gripped during drawing movements of the bowstring.

A first flexible link 40 extends between the arms 18 and 20 and is connected to the arms by connecting devices 42 and 44 on the respective arms. A second link 46 is connected to the first link 40 by projectile engaging and connecting device 50 and to the bowstring 30 by connecting device 52. A third link 48 is connected to the first link 40 by a projectile engaging and connecting device 54 and to the bowstring 30 by a connecting device 56. Links 46 and 48 thus establish a connection between the link 40 and the bowstring 30. A projectile or arrow 58 is shown to better illustrate the functioning of the bow. The bow is shown in a drawn position by the broken lines 30'. Connecting device 44 comprises an adjustable eyebolt for adjusting tension in the link 40. The eyebolt also functions as an intermediary to operatively connect the link 40 to the arm 20.

The projectile engaging and connecting devices 50 and 54 perform dual functions of engaging and helping to hold the arrow 58 in position on link 40 during drawing movements of the bowstring 30 and also connect the links 46 and 48 to link 40.

During operation of this bow a rearward energy loading drawing movement of the bowstring main span 30 is greater than the rearward movement of the arrow 58 and projectile engaging and connecting devices 50 and 54. This is an important feature of the bow. The energy storing draw length is of normal length for the archer and is not shortened due to the shorter arrow.

Furthermore, the fact that the arrow 58 is not drawn rearwardly past the hand grip 12 is an important safety factor.

While the bow of this embodiment employs two flexible arms, other bows which employ only one flexing arm may be employed. Furthermore, the links 46 and 48 may be made of resilient material such as latex or rubber.

FIG. 2 shows an improved arrow rest 16, such rest partially encircling the arrow 58 to retain it in position under adverse conditions.

With reference to FIG. 3 another embodiment is provided which employs principles of the invention on a bow with frame portion 60 which includes hand grip 62, a projectile or arrow shelf 64 and projectile or arrow rest 68. A pair of flexible arms 70 and 72 extend oppositely from the frame portion 60 and include stiff tip ends 74 and 76 respectively. A bowstring 78 extends between the arms 70 and 72 and is connected to the tip ends 74 and 76 by connecting devices 80 and 82 respectively. Bowstring 78 includes an enlargement 84 to indicate the portion to be gripped during drawing movements of the bowstring.

A first flexible link 86 extends between the bow arms 70 and 72 and is connected to these arms by devices 88 and 90 respectively. A second flexible link 92 is connected to the bowstring 78 by connecting device 94 and to the first link 86 by projectile engaging and connecting device 96. A third link 98 is connected to the bowstring 78 by connecting device 100 and to the first link 86 by projectile engaging and connecting device 102. Links 92 and 98 thus establish a connection between the link 86 and the bowstring 78. The projectile engaging and connecting devices 96 and 102 of this embodiment function similarly to the projectile engaging and connecting devices 50 and 54 of the bow shown in FIG. 1 in that they perform dual functions of engaging and helping to hold a projectile in position and also serving as connecting devices. The second link 92 and the third link 98, similar to the second link 46 and the third link 48 of the bow of FIG. 1, may be made of resilient material such as rubber or latex.

This bow, as in the bow of FIG. 1, employs an assembly which includes a link extending between the bow arms. The host bow for the assembly shown in FIG. 3 employs arm tip ends 74, 76, which are stiff and resist bending during drawing movements of the bowstring 78. Since the link 86 is positioned inwardly from the tip ends 74 and 76, it is obvious that the bowstring 78 has more mechanical advantage than the link 86 and will travel rearwardly more than the link 86 during drawing movements.

With reference to FIG. 4 there is shown still another embodiment employing the principles of the invention. This embodiment is simple and employs a first link 104 which extends between the arms. Projectile engaging devices 106 and 108 hold the projectile 116 on the link 104. A second link 110, which is constructed of resilient material, connects the link 104 to the bowstring 112 and functions similar to the second and third links 46 and 48 of the bow shown in FIG. 1. An enlargement 114 indicates the portion of the bowstring 122 to be gripped during drawing movements of the bowstring. The link includes a thinner mid-portion 110*a* and may be constructed of such resilient materials as latex, rubber or the like. The function of this link is to draw the link 104 rearward with the bowstring 112 during drawing movements of the bow. Due to the simplicity of this embodiment it is believed to be important.

The assemblies comprising links 40, 46, and 48 of the bow of FIG. 1, the links 86, 92 and 98 of the bow of FIG. 3, and the links 104 and 110 of the bow of FIG. 4 may be incorporated into the bow during manufacture or made as an after-market assembly to be added to existing bows. The assemblies are adaptable to a variety of host bow types.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. A flexible force transferring mechanism for an archery bow comprising flexible link means for positioning between arms of a bow and forwardly of a bowstring of a bow for engaging and propelling projectile, attaching means connected to said flexible link means for operatively securing said flexible link means to a bow's arms, projectile engaging means on said flexible link means for releasable engagement with a projectile, and connecting means on said flexible link means including an elongated element extending toward an archer when in use on a bow from said flexible link means for connecting said flexible link means to a bowstring, said elongated element including a bowstring engaging means for engaging a bowstring rearwardly of said flexible link means.

2. The mechanism of claim 1 wherein said connecting means comprises a single elongated element with opposite ends for connection to said link means and a bowstring.

3. The mechanism of claim 1 wherein said connecting means is resilient.

4. The mechanism of claim 1 wherein said mechanism includes means to adjust the length of said link means.

5. An archery bow comprising a bow frame portion, a pair of arms extending oppositely from said frame portion in a rearward direction, said arms having a pair of tip ends and at least one of said arms being flexible to provide tension for said bow, a bowstring extending between said tip ends for drawing by an operator to provide a tension in the bow to propel a projectile, flexible link means extending between said arms and positioned forwardly of said bowstring for engaging and propelling a projectile, attaching means attaching said flexible link means to said bow arms, projectile engaging means on said flexible link means for releasable engagement with a projectile, and connecting means comprising an elongated element connecting said flexible link means to said bowstring, said elongated element extending toward an archer and including a bowstring engaging means for engaging a bowstring rearwardly of said flexible link means.

6. The archery bow of claim 5 wherein said connecting means comprises a single elongated element connecting said flexible link means to said bowstring.

7. The archery bow of claim 5 wherein said connecting means comprises a pair of elongated elements connecting said flexible link means to said bowstring.

8. The archery bow of claim 7 wherein one of said pair of elongated elements is connected to said flexible link means above said projectile engaging means and the other elongated element is connected to said flexible link means below said projectile engaging means.

9. The archery bow of claim 5 wherein said connecting means is resilient and provides a resilient connection between said flexible link means and said bowstring.

* * * * *